United States Patent [19]

Marstiller et al.

[11] Patent Number: 4,892,998

[45] Date of Patent: Jan. 9, 1990

[54] SEMI-CONDUCTIVE ELECTRICAL HEATING DEVICE WITH VOIDS

[75] Inventors: John A. Marstiller, Marston Mills; Paul H. Bodensiek, Waltham; Frederick G. J. Grise, Osterville, all of Mass.

[73] Assignee: Flexwatt Corporation, West Wareham, Mass.

[21] Appl. No.: 138,857

[22] Filed: Dec. 29, 1987

[51] Int. Cl.[4] ..... H05B 3/10

[52] U.S. Cl. ..... 219/548; 338/333; 219/532

[58] Field of Search ..... 219/345, 532, 545, 546, 219/548, 553, 549, 543, 541; 338/206, 333, 212, 295

[56] References Cited

U.S. PATENT DOCUMENTS 3,266,005 8/1966 Balde et al. ..... 338/308

3,287,161 11/1966 Schwertz et al. ..... 427/102

3,664,013 5/1972 MacGuire ..... 219/345

3,704,359 11/1972 Laing ..... 219/345

4,485,297 11/1984 Grise et al. ..... 219/528

*Primary Examiner*—B. A. Reynolds

*Assistant Examiner*—M. Lateef

[57] ABSTRACT

Heating devices, in which a semi-conductor pattern is carried on an insulating surface and a pair of spaced apart electrodes are electrically connected to the semi-conductor pattern, are characterized in that the semi-conductor pattern in at least one heating area of the device defines a two-dimensional array of areas that are devoid of semi-conductor material ("voids") within a continuous "mesh" of semi-conductive material. Preferably, the voids are hexagons arranged with the sides of adjacent hexagons parallel to each other, the centers of adjacent hexagons are at the corners of equilateral triangles, and the overall direction of current flow in the device is not parallel to any of the sides of the triangles.

26 Claims, 5 Drawing Sheets

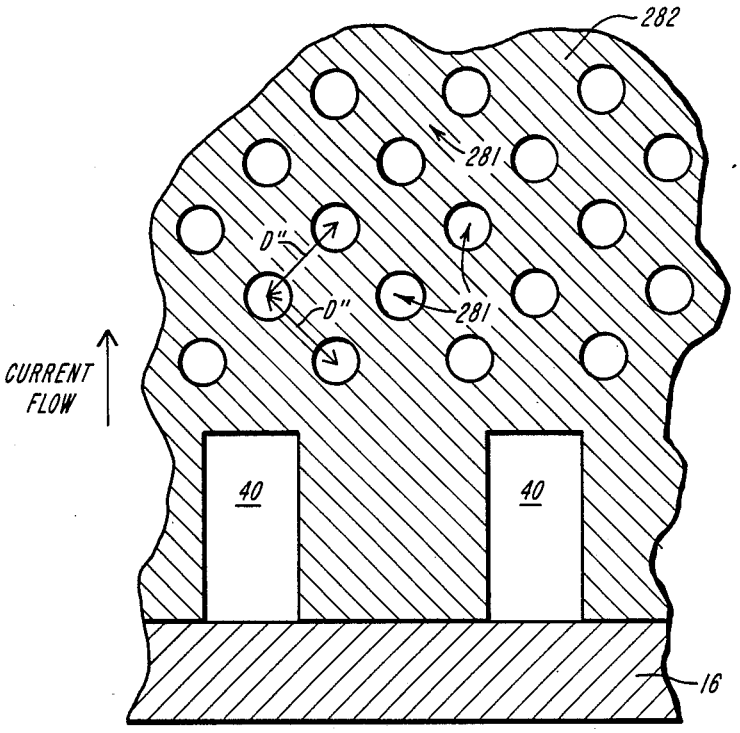
FIG. 6
FIG. 7
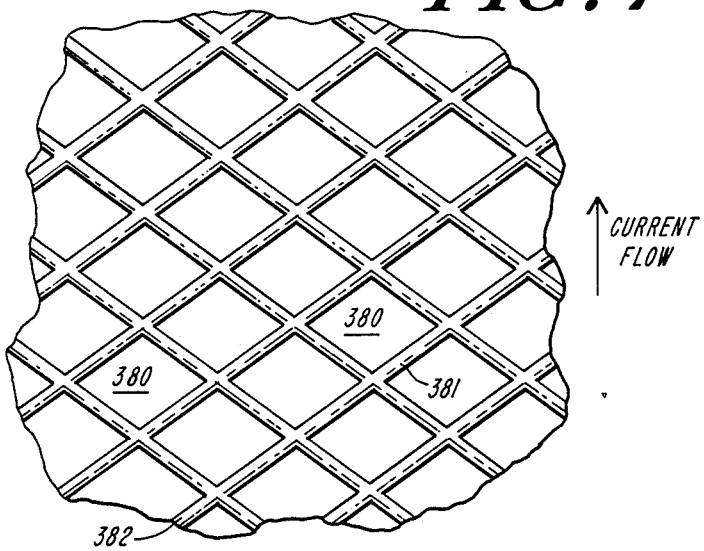

SEMI-CONDUCTIVE ELECTRICAL HEATING DEVICE WITH VOIDS

FIELD OF INVENTION

This invention relates to electrical heating devices and, more particularly, to devices including a pattern of conductive material carried on an insulating surface.

BACKGROUND OF INVENTION

U.S. Pat. No. 4,485,297 discloses an electrical heating device in which a semi-conductor pattern is printed on an insulating substrate. The pattern includes a pair of parallel longitudinal stripes and a plurality of bars extending obliquely between the stripes. The heating device is designed to produce a uniform watt density over the heated area, and the patent teaches that the watt density may be varied by changing the oblique angle between the bars and stripes.

U.S. Pat. No. 4,633,068, discloses a heating device, particularly suited for use as an infrared imaging target, which similarly includes a semi-conductor pattern including a plurality of bars extending between a pair of longitudinally-extending stripes. Different areas of the device there disclosed have different watt densities, the variation in watt density between the different areas being accomplished by varying the width of selected bars along their length.

U.S. Pat. No. 4,542,285 discloses conductors useful for connection to semi-conductor pattern of devices such as those in the above-referenced patent and application. The conductor comprises a conductive metal strip having a pair of transversely-spaced, longitudinally-extending strip portions and, therebetween, a central portion that includes a plurality of longitudinally-spaced openings. As disclosed, one of the conductor's strip portions overlies a stripe of the semi-conductor pattern, and an overlying insulating layer is sealed to the layer carrying the semi-conductor pattern through the openings in the central portion and along the inner and outer edges of the conductor.

The above identified U.S. Patents are hereby incorporated by reference.

SUMMARY OF INVENTION

The present invention provides a conductive pattern that, using a thin, essentially uniform layer of conductive material (e.g., a semi-conducive ink printed at a substantially uniform thickness) makes it possible to produce areas of varying size and shape which have significantly different resistivities (ohms per square); and thereby makes it possible to make, for example, heating devices in which different heating areas of the same size or configuration have different watt densities, or in which the same watt density is produced in different heating areas of very different size or configuration. The invention also makes it possible to produce a heater that is highly resistant to tearing and delamination; and to produce anti-static devices.

According to the present invention, heating devices, e.g., of the type in which a semi-conductor pattern is carried on an insulating surface and a pair of spaced apart electrodes are electrically connected to the semi-conductor pattern, are characterized in that the semi-conductor pattern in at least one heating area of the device defines a two-dimensional array of areas that are devoid of semi-conductor material ("voids") within a continuous "mesh" of semi-conductive material. Preferably, another heating area of the device is connected in series with the first area and comprises an area, printed with the same ink at the same thickness as in the first area, either (i) substantially all of which is covered with semi-conductive material or (ii) which contains a mesh-void pattern different from that in the first area. In heating areas in which the semi-conductor pattern is arranged in a mesh-void pattern, the voids cover not more than about 90% of the heating area and are preferably arranged in a regular, typically rectilinear, array (e.g., the centers of adjacent voids form triangles, squares, parallelograms or diamonds). Each void has an area not more than that of a circle about ½ inch in diameter, and the minimum distance between adjacent voids (i.e., the minimum width of the semi-conductive material mesh) is about 0.015 to 0.020 inch. In most preferred embodiments, the centers of the adjacent voids are at the corners of equilateral triangles and each void is a hexagon having an inscribed circle diameter of not more than about ¼ inch; and an insulating cover sheet is bonded to the substrate through the voids.

DESCRIPTION OF DRAWINGS

FIGS. 5–7 illustrate other semi-conductor mesh-void plan view of another electrical heating device, embodying the invention.

DETAILED DESCRIPTION OF PREFERRED EMBODIMENT

Figure 1:
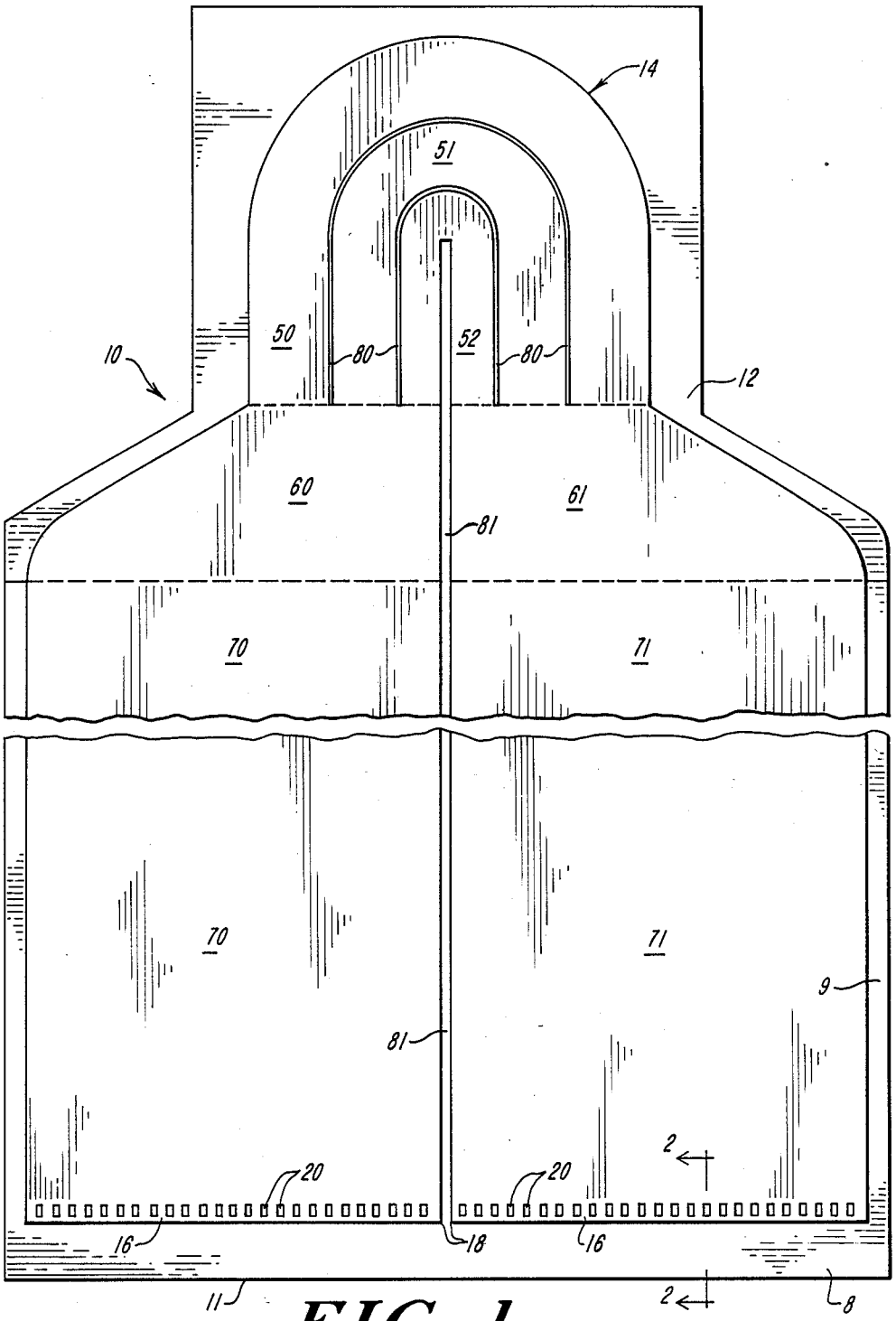
FIG. 1 is a plan view of an electrical heating device constructed in accord with the present invention, with the top insulating layer and metal conductors of the device removed for purposes of clarity.

Referring now to FIGS. 1–4, there is shown an electrical sheet heater, generally designated 10, comprising an electrically-insulating plastic substrate 12 on which is printed a semi-conductor pattern 14 of colloidal graphite. In the embodiment shown, the heater is intended for use as an infrared imaging target, and the semi-conductor pattern is designed to produce a thermal image similar to that produced by a human being.

As shown, substrate 12 is 0.004 inch thick polyester ("Mylar"), and the relative size of the substrate 12 and semi-conductor pattern 14 are such as to provide an uncoated side boundary area 8, between the outer edges of the semi-conductor pattern 14 and the edges of the substrate. Area 8 has a minimum width of ½ inch along the sides 9 of the target and of 1¼ inch along the target bottom 11. The semi-conductor pattern provides a watt density of about 12–15 watts per square foot over its surface when the heater is connected to a 110 volt power source.

For connecting the target to a power source, the semi-conductor pattern 14 includes a pair of connecting portions 16, each about 5/32 inch wide, extending generally across the target bottom. As shown, the connecting portions are aligned with each other, with an about ¼ inch wide space 18 (i.e., an insulating area free of semi-conducting material) between their adjacent ends. A series of small rectangles 20, each about ¼ inch high and ⅛ inch wide are spaced along the length of each connecting portion 16, with the lower edge of each rectangle 20 about 5/32 inch from the bottom edge of the connecting portion. The distance between adjacent rectangles 20 is ¼ inch.

A pair of electrodes 22, each comprising a tinned copper strip 1 inch wide and 0.003 inch thick, extend across the bottom of the target. Each electrode 22 partially overlies and electrically engages a respective one of connecting portions 16. As shown most clearly in above-referenced U.S. Pat. No. 4,542,285, each electrode includes two transversely-spaced longitudinally-extending rows of spaced square holes 24, with solid copper strips 26, 28 and 30 being provided along the inner and outer edges of the electrode and between the two rows of holes.

Figure 2:
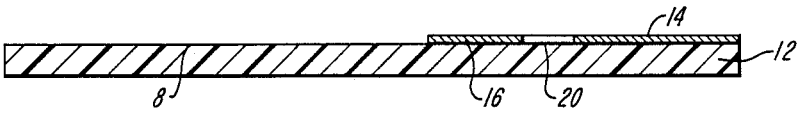
FIG. 2 is a sectional view taken at lines 2—2 of FIG. 1 and FIG. 3.
Figure 2A:
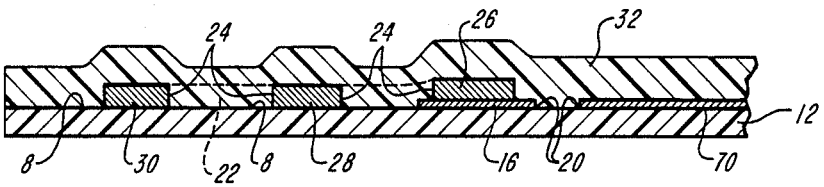
FIG. 2A is a sectional view, similar to FIG. 2 and taken at lines 2—2 of FIGS. 1 and 3, but illustrating the device with the top sheet and metal conductors in place.

A thin electrically insulating plastic cover sheet 32, is shown in FIG. 2 and comprises an essentially transparent colamination of an 0.005 cm. (0.002 in.) thick polyester ("Mylar") and an 0.007 cm (0.003 in.) thick adhesive binder, e.g., polyethylene, overlies substrate 12, semi-conductor pattern 14, and conductors 22. The conductors 22 are not themselves bonded to the underlying substrate or semi-conductor material. However, the cover sheet 32 (which is coextensive with the entire substrate 12) bonds tightly to the uncoated (with semi-conductor material) areas 8 of substrate 12 (along the marginal areas where the two sheets are in face-to-face engagement and through the holes 24 in conductors 22), and also to the uncoated rectangular areas 40 spaced along the inside edges of conductor strips 26. In the areas in which (as discussed hereinafter) the conductive material is printed in a mesh-void pattern, the cover sheet 32 bonds to the substrate 12 in the voids also.

Typically, substrate 12 and cover sheet 32 are essentially transparent. In military target applications, cover sheet 32 may be painted the color of, e.g., a tank.

The portions of semi-conductor pattern 14 which produce the desired thermal image include three generally "U" shaped "heating" portions, designated 50, 51 and 52, respectively, which form the "head" of the target; a pair of generally trapezoidal "heating" portions, designated 60 and 61, respectively, which form the "shoulders" of the target; and a pair of rectangular "heating" portions, designated 70 and 71, respectively, which form the rest of the body.

In all three areas, the semi-conductor ink is printed at essentially the same thickness, e.g., about 0.0005 in.; and the resistivity (ohms per square) of the areas actually covered by ink, is essentially the same throughout. As will become apparent, however, the resistivities of the three areas on a layer scale (e.g., on a scale including both the areas covered by ink and, in the shoulder and body portions, the array of "voids") differ. As shown, U-shaped semi-conductor-free insulating areas 80 are provided between the adjacent "head" portions 50, 51 and 52, and another semi-conductor-free insulating area 81 is provided between the adjacent "body" portions 70 and 71 and between the adjacent "shoulder" portions 60 and 61. The heating portions 51, 51 and 52 which form the head are connected (in parallel with each other) electrically in series with "shoulder" portions 60 and 61, and each of "body" portions 70 and 71 is connected electrically in series between a respective one of "shoulder" portions 60, 61 and a respective one of connecting portions 16.

In each of "head" portions 50, 51, and 52, the semi-conductor colloidal graphite material is printed over the entire area, covering the entire area at a uniform thickness, typically in the range of 0.3 to 1.0 mil. In connecting portions 16, the semi-conductor material similarly covers the entire area of the connecting portions, except for the rectangular openings 40 that provide for bonding of the top sheet 32 to substrate 14 and hold conductors 22 in place.

In the "shoulder" portions 60, 61, and in the "body" portions 70, 71, the resistivity (ohms per square) required to produce the desired watt density typically cannot be obtained by printing the semi-conductor colloidal graphite material over the entire area at the same thickness at which it is printed over the "head" portions 50, 51 and connecting portions 16. In each of portions 60, 61, 70, and 71, the semi-conductor material is printed over the area in an open mesh pattern, i.e., a regular array of small areas which are devoid of semi-conductor material ("voids") within a continuous semi-conductor "mesh" that surrounds the "voids" and covers the rest of the respective portion. Although the resistivity of the ink layer itself remains constant, the resistivity (ohms per square) and resulting watt density of a portion including voids depends on, and varies according to, the void configuration and pattern (e.g., the arrangement and spacing of, and the percentage of the overall area that is covered by the voids). An area in which the "voids" cover 50 percent of the entire area typically will have greater resistivity than will an area in which the "voids" cover only 25 percent of the area; and the least resistivity typically will be found in an area in which the percentage of "voids" is zero, i.e., in an area, such as "head" portions 50, 51, 52, all of which is coated or printed with semi-conductor material.

Figure 3:
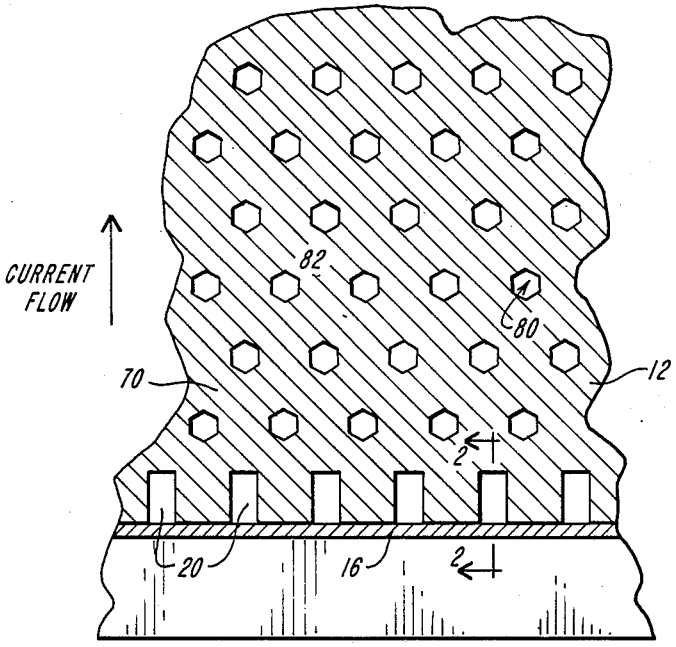
FIG. 3 is an enlarged view of a portion of the semi-conductor pattern of the device of FIG. 1.
Figure 4:
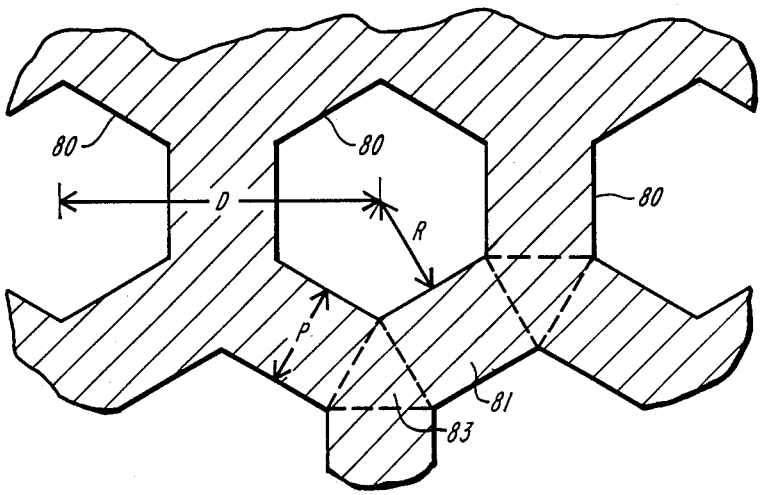
FIG. 4 is a diagram illustrating aspects of the semi-conductor pattern shown in FIG. 1.

In the embodiment of FIGS. 1–4, the voids are hexagonal and are arranged in a regular rectilinear array in which the centers of adjacent voids form equilateral triangles. FIG. 3 is an enlarged view of part of "body" portion 70 illustrating the hexagonal voids 80 and semi-conductor material mesh 82, and FIG. 4 is a diagram further illustrating the geometry of the FIG. 3 void-mesh pattern. In FIG. 4, the distance between the centers of adjacent hexagonal voids 80 is designated "D", the distance from the center to each corner of a void (and hence the radius of a circle tangent to the inside of and subscribed by the void) is designated "R", and the width of the semi-conductor material mesh strips 81 between adjacent voids is designated "P". As will be apparent, the relationship between these three distances is: $P=D-2R$.

It has been found that "P" should not be less than about 0.015 inches, preferably not less than about 0.020 inches, and that R should not be less than 1/64 inch, preferably not less than about 1/32 inch. To provide even heating over the entire area, it also has been found desirable that the individual voids should not be too large, e.g., R typically should not exceed about ¼ inch.

In the hexagonal void pattern of FIG. 4, the width of the semi-conductor mesh strip 81 between each pair of adjacent voids 80 essentially constant, and the overall mesh pattern consists of a series of constant width strips 81 joined at their ends (adjacent the corners of the hexagonal voids) by equilateral triangular portions 83 each side of which is equal in length to the strip width. It also will be noted that the percentage of an overall heating portion that is covered by semi-conductor material depends on spacing between voids and the width of the mesh strips between adjacent hexagonal voids; theoretically, it may vary from 0% (P=0; each hexagon is so large that the adjacent voids abut each other) to 100% (P=D; the entire area is covered with semi-conductor material; each hexagon has an area of zero). In a typical arrangement in which the distance D between void centers is 0.375 in., if P is 0.015 in. voids will cover about 90% of the overall area, and the semi-conductor mesh will cover the remaining about 10%. It will be noted that the percentage covered by the voids may be somewhat increased by increasing center-to-center spacing of the voids while maintaining or (if printing will permit) decreasing P; and that the percentage of void coverage can be decreased as desired by reducing the voids size (R) or by maintaining the void size while increasing "D".

In the heater of FIG. 1, the hexagonal voids in the "shoulder" portions 60, 61 and "body" portion 70, 71 are arranged so that the distance between adjacent voids is 0.375". In "shoulder portions" 60, 61, the voids are sized (R=0.10 in.) so that the voids in the mesh-void pattern cover about 20% of the area of the shoulder portions. In body portions 70, 71 the voids are larger (R=0.14 in.), and the voids cover about 40% of the overall area.

The resistivity (ohms per square) of an area comprising a mesh-void pattern is greater than that of an area completely covered by the same semi-conductor material printed at the same thickness. Using a mesh-void pattern in which the shape and center-to-center again of the voids remains the same, the resistivity of an area generally can be increased by using larger voids, and decreased if the voids are made smaller.

With reference to the heater of FIGS. 1–4, it thus will be seen that the resistivity (ohms per square) in the head portions 50, 51, 52 (which are entirely covered with semi-conductive material) is less than that in any of the other portions of the semi-conductor pattern (which are mesh-void patterns). Similarly, the resistance (ohms per square) in the shoulder portions 60, 61 (in which the voids cover about 20% of the total area) is less than that in body portions 70, 71 (in which the voids cover about 40% of the area). In the illustrated embodiment, the resistance in the "shoulder" portions 60, 61 is about 130% of that in head portions 50, 51, 52; and that in body portions 70, 71 is about 180% of that in the head portions. However, the overall sizes and shapes of the various portions are such that the watt densities produced by each of the "body" and "shoulder" portions (which represent portions of a human's body that will be clothed and thus should appear to an infrared imaging device to be slightly cooler than an unclothed head) are about the same, and are slightly less than the watt density produced by the head portions.

It will be noted that, in each of "shoulder" portions 60, 61 and "body" portions 70, 71, the direction of current flow is generally vertical. In areas that include a mesh-void pattern, it normally is desirable that the lines connecting the centers of adjacent voids not be parallel to the overall direction of current flow. Thus, the mesh-void patterns in the shoulder and body portions are oriented such that the sides of the equilateral triangles connecting adjacent voids are either perpendicular or at a 30° angle to the generally vertical current flow direction. Similarly, if the void centers were arranged in a square pattern, it would normally be desirable to orient the pattern so that the sides of the squares form 45° angles to the current flow direction.

Figure 5:
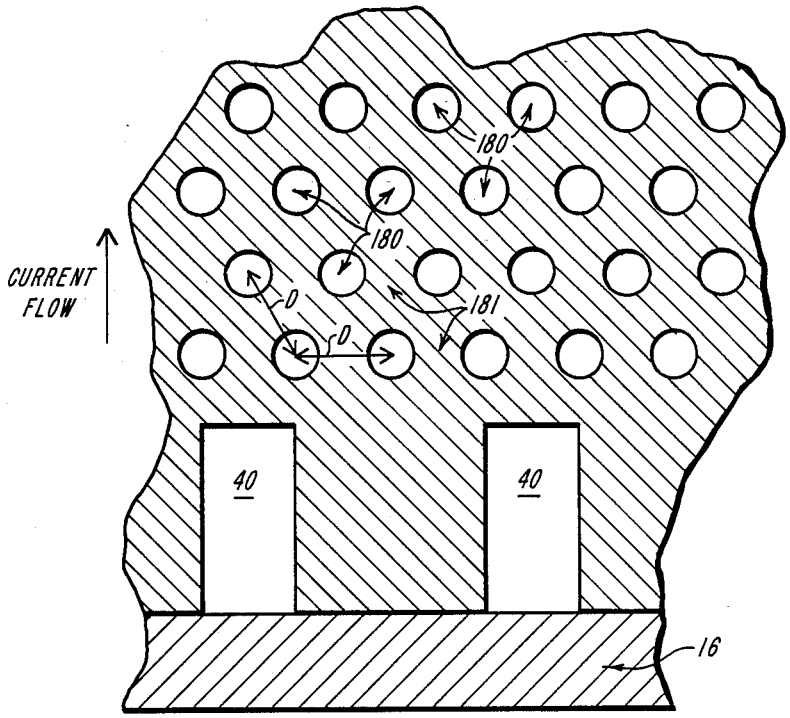

Alternative mesh-void patterns, in which the voids are circular, are shown in FIGS. 5 and 6.

In the FIG. 5 pattern, the circular voids 180 are arranged so that the centers of three adjacent voids form equilateral triangles, the distance between the centers of adjacent voids being designated D', the radius of each void being designated R', and the width of the semi-conductor material mesh between adjacent voids being designated P'. The minimum width of the semi-conductor mesh strips 181 between each pair of voids 180 is located on the line connecting the centers of the voids and is equal to D'−2R'.

The circular voids 280 in the FIG. 6 pattern are arranged with the centers of four adjacent voids located at the corners of a square. The distance betwen the centers of two adjacent voids, i.e., the length of each side of each square, is D", the radius of each void 280 is R", and the minimum width 8" of the semi-conductor strip 281 between two adjacent voids 281 (which again is located on the line connecting the void centers) is D"−2R".

In the circular void patterns of FIGS. 5 and 6, the semi-conductor mesh strips 181, 281 between adjacent pairs of voids 180, 280 vary in width. In each, the minimum width is on the line connecting the center of adjacent pairs of voids and the width of the end portions of each strip is considerably greater. Thus, and unlike in the hexagonal void pattern of FIG. 4, there is considerable variation in resistance along the length of each mesh strip 181, 281. It also will be noted that circular void patterns cannot be used when it is desirable for the voids to cover a large percentage of the overall heating area. For example, in the FIG. 5 pattern in which the centers of the circular voids are located at the corners of equilateral triangles, the maximum theoretical percentage of the overall heating portion areas covered by voids (i.e., the percentage covered when R is almost as large as P/2 and adjacent voids are almost tangent to each other) is about 90%; in the FIG. 6 pattern, in which the void centers are located at the corners of squares, the maximum theoretical percentage that can be covered by voids is about 20%. As a practical matter, the requirement that P be not less than about 0.015 in. means that the maximum void coverage that can be obtained using circular void patterns is considerably less than the theoretical maximum (e.g., about 80% equilateral triangle corner pattern; and about 60% using a square corner pattern) and to insure good printing and even heating, circular void patterns typically will not be employed in circumstances in which it is desirable for the voids to cover more than about ⅔ of the heating area.

OTHER EMBODIMENTS

In other embodiments, the other void shapes and patterns may be employed. For example, the voids need not be circular or hexagonal in shape, e.g., squares, ovals, triangles or irregular shapes could be used; in some circumstances the centers of the voids may not be arranged in a regular or rectilinear array; and in some circumstances it may be desirable to create the mesh-used pattern by printing over an entire are and then "punching-out" the voids.

FIG. 7, for example, illustrates, enlarged, a void-mesh semi-conductor pattern of the present invention, in which the "voids" 380 are in the shape of diamonds so arranged that diamond centers are located on the corners of parallelograms the sides of which are about 0.4 in. long. The mesh 382 between voids comprises interconnected stripes 381 about 0.020 in. wide.

Figure 8:
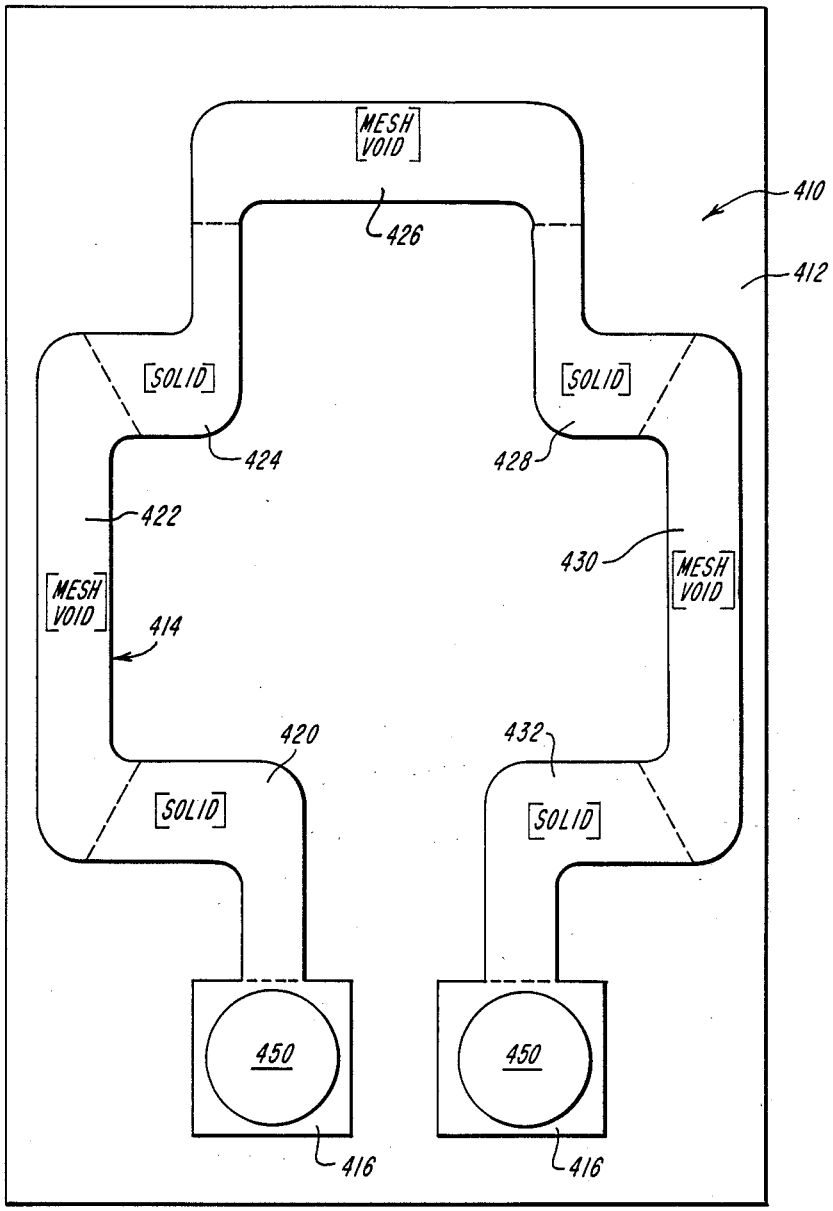
FIG. 8 is a schematic plan view of another heater embodying the invention.

FIG. 8 illustrates a special purpose heater 410 in which a serpentine semi-conductor pattern 414 of varying overall width is printed on a paper substrate 412. The pattern 414 includes a solid conductor contract portion 416 at each end of the pattern, and a number of serially-connected heating portions designated 420, 422, 424, 426, 428, 430, 432 therebetween. Heating portions 420, 424, 428 and 432 are "solid" (i.e., the semi-conductor material covers the entire area of each). Heating portions 422, 426 and 428 are printed in a mesh-void pattern. In portions 422 and 428, the mesh-void pattern comprises hexagonal voids aligned in an equilateral triangle portion with D=0.375 in. and R=0.0625 in. In portion 426, the mesh void pattern comprises hexagons of the same size arranged in an equilateral triangle pattern in which D=0.250 in. Circular tinned copper conductors 450 are held in face-to-face electrical contact with each of conductor contact areas 416 by, e.g., a conductive adhesive.

These and other embodiments will be within the scope of the following claims.

What is claimed is:

1. An electrical heating device including a layer of semi-conductive material carried on an insulating surface and defining a semi-conductive pattern, and a pair of spaced-apart conductors electrically connected to said semi-conductive pattern, said device being characterized in that a first heating portion of said semi-conductive pattern intermediate said conductors includes a two-dimensional array of areas devoid of semi-conductive material ("voids") within a mesh of semi-conductive material, said voids being arranged such that the centers of the voids forming sets of three adjacent voids are positioned at the corners of equilateral triangles.

2. The heating device of claim 1 further characterized in that said voids are circles or regular polygons.

3. The device of claim 1 wherein said voids are hexagons and are arranged such that the overall direction of current flow between said conductors is not parallel to the sides of said triangles.

4. An electrical heating device including a layer of semi-conductive material carried on an insulating surface and defining a semi-conductive pattern, and a pair of spaced-apart conductors electrically connected to said semi-conductive pattern, said device being characterized in that a first heating portion of said semi-conductive pattern intermediate said conductors includes a two-dimensional array of areas devoid of semi-conductive material ("voids") within a mesh of semi-conductive material, and said conductors and said voids being arranged such that the centers of the voids forming sets of three adjacent voids are positioned at the corners of triangles, and the overall direction of current flow between said conductors is not parallel to the sides of said triangles.

5. The heating device of claim 1 further characterized in that said voids are hexagons, that the centers of sets of four adjacent hexagons are positioned at the corners of parallelograms, and that sides of adjacent hexagons are parallel to each other.

6. The device of claim 4 wherein said voids are hexagons and are regularly arranged with sides of adjacent hexagons parallel to each other.

7. An electrical heating device including a layer of semi-conductive material carried on an insulating surface and defining a semi-conductive pattern, and a pair of spaced-apart conductors electrically connected to said semi-conductive pattern, said device being characterized in that a first heating portion of said semi-conductive pattern intermediate said conductors includes a two-dimensional array of areas devoid of semi-conductive material ("voids") within a mesh of semi-conductive material, said voids being hexagons arranged such that the centers of the voids forming sets of four adjacent hexagons are positioned at the corners of parallelograms.

8. The heating device of claim 1 further characterized in that the minimum width of semi-conductive material of said mesh intermediate adjacent ones of said voids is not less than about 0.015 in.

9. An electrical heating device including a layer of semi-conductive material carried on an insulating surface and defining a semi-conductive pattern, and a pair of spaced-apart conductors electrically connected to said semi-conductive pattern, said device being characterized in that first and second heating portions of said semi-conductive pattern intermediate said conductors each include a respective regular two-dimensional array of areas devoid of semi-conductive material ("voids") within a mesh of semi-conductive material, and said second heating portion of said semi-conductor pattern is contiguous to said first heating portion and has a resistivity (ohms per square) different from that of said first portion.

10. The heating device of claim 9 wherein said first heating portion and said second heating portion each comprises a respective regular two-dimensional array of hexagonal voids.

11. The heating device of claim 9 wherein the distance between the centers of the voids in said first and second heating portions are the same, and the size of the voids in said first portion is greater than the size of the voids in said second portion.

12. The heating device of claim 9 wherein the percentage of said first portion covered by semi-conductor material is greater than the percentage of said second portion covered by semi-conductor material.

13. The heating device of claim 9 wherein at least one of the configuration, center-to-center-spacing and size of the voids of said first portion is different from the respective one characteristic of the voids of the second portion.

14. The heating device of claim 1 further characterized in that the area of each of said voids is not more than that of a circle about ½ in. in diameter.

15. The heating device of claim 14 where said voids are regularly spaced circles or polygons and the minimum width of the semi-conductor mesh between adjacent voids is not less than about 0.015 inch.

16. The heating device of claim 15 wherein the percentage of said first heating portion covered by said voids is between 10 and 90.

17. An electrical heating device comprising:

a substrate;

a layer of semi-conductor material carried on an insulating surface of said substrate and defining a semi-conductor pattern including a pair of spaced-apart conductor contact portions and at least one heating portion; and a pair of spaced-apart electrical conductors each of which electrically engages one of said conductor contact portions of said semi-conductor pattern;

said device being characterized in that:

said heating portion comprises a regular two-dimensional array of areas devoid of semi-conductor material ("voids") within a continuous mesh of semi-conductor material, said voids being circles or polygons and being arranged such that the centers of the voids forming sets of three adjacent voids are positioned at the corners of equilateral triangles.

18. The device of claim 17 wherein the minimum distance between the adjacent edges of adjacent ones of said voids being not less than about 0.015 in.

19. The device of claim 18 wherein said voids are hexagons, and are arranged such that the centers of sets of four adjacent hexagons are positioned at the corners of a parallelogram having sides of substantially equal length and an included angle of about 60°.

20. In an electrical device comprising:

a substrate having an insulating surface; and a layer of conductive material carried on said insulating surface of said substrate and defining a conductive pattern, that improvement wherein said pattern comprises a regular two-dimensional array of areas devoid of conductive material ("voids") within a continuous mesh of conductive material, said voids being circles or regular polygons and being arranged such that the centers of the voids forming sets of three adjacent voids are positioned at the corners of equilateral triangles.

21. The device of claim 20 wherein said voids are hexagons, the minimum distance between the adjacent edges of adjacent ones of said hexagons is not less than about 0.015 in., and said hexagons are arranged such that the centers of sets of four adjacent hexagons are positioned at the corners of a parallelogram having sides of substantially equal length and an included angle of about 60°.

22. The device of claim 21 including an electrically insulating sheet overlying said substrate and conductive pattern and adhesively attached to said voids.

23. The device of claim 20 wherein said voids are hexagons.

24. The device of claim 23 wherein said voids are regularly arranged with sides of adjacent hexagons parallel to each other.

25. The device of claim 17 wherein said voids are hexagons.

26. The device of claim 25 wherein said hexagons are arranged with the sides of adjacent hexagons parallel to each other and such that the overall direction of current flow between said conductors is not parallel to the sides of said triangles.

* * * * *